US012605604B2

(12) United States Patent
Van Nguyen

(10) Patent No.: US 12,605,604 B2
(45) Date of Patent: Apr. 21, 2026

(54) VIBRATION DAMPER FOR A BAT KNOB AND/OR END CAP

(71) Applicant: Thu Van Nguyen, West Hills, CA (US)

(72) Inventor: Thu Van Nguyen, West Hills, CA (US)

( * ) Notice: Subject to any disclaimer, the term of this patent is extended or adjusted under 35 U.S.C. 154(b) by 563 days.

(21) Appl. No.: 18/140,885

(22) Filed: Apr. 28, 2023

(65) Prior Publication Data

US 2023/0264085 A1 Aug. 24, 2023

Related U.S. Application Data

(63) Continuation-in-part of application No. 17/212,151, filed on Mar. 25, 2021, now Pat. No. 11,771,969.

(51) Int. Cl.

| | |
|---|---|
| ***A63B 60/54*** | (2015.01) |
| ***A63B 59/51*** | (2015.01) |
| ***A63B 60/16*** | (2015.01) |
| ***A63B 102/18*** | (2015.01) |

(52) U.S. Cl.

CPC ..... *A63B 60/54* (2015.10); *A63B 60/16* (2015.10); *A63B 59/51* (2015.10); *A63B 2102/18* (2015.10); *A63B 2102/182* (2015.10); *A63B 2209/00* (2013.01)

(58) Field of Classification Search

CPC ..... A63B 60/54; A63B 60/16; A63B 59/51; A63B 2102/18; A63B 2102/182; A63B 2209/00

See application file for complete search history.

(56) References Cited

U.S. PATENT DOCUMENTS

| | | | | | |
|---|---|---|---|---|---|
| 3,703,290 | A * | 11/1972 | Wilson | A63B 59/51 | 473/566 |
| 5,772,541 | A * | 6/1998 | Buiatti | A63B 53/14 | 473/549 |
| 5,785,617 | A * | 7/1998 | MacKay, Jr. | A63B 59/50 | 473/566 |
| 2003/0040384 | A1* | 2/2003 | Falone | A63B 60/54 | 473/568 |
| 2009/0069127 | A1* | 3/2009 | James | A63B 69/0091 | 473/422 |
| 2018/0086420 | A1 | 3/2018 | Schenck et al. | | |

FOREIGN PATENT DOCUMENTS

| | | | | |
|---|---|---|---|---|
| CA | 2432286 | | 8/2002 | |
| CN | 212107440 | U | 12/2020 | |
| GB | 2247932 | A | 3/1992 | |
| WO | WO-2017173095 | A1 * | 10/2017 | A41D 31/285 |

* cited by examiner

*Primary Examiner* — Jeffrey S Vanderveen

(74) *Attorney, Agent, or Firm* — KELLY & KELLEY, PLLC

(57) ABSTRACT

A baseball or softball bat includes a barrel extending from a handle having a knob. A cap defining a chamber partially filled with gel is attached to an end of the barrel or the knob for dissipating vibrations created when the bat strikes an object.

17 Claims, 11 Drawing Sheets

VIBRATION DAMPER FOR A BAT KNOB AND/OR END CAP

RELATED APPLICATIONS

This application is a continuation-in-part of U.S. application Ser. No. 17/212,151, filed on Mar. 25, 2021.

FIELD OF THE INVENTION

The present invention generally relates to baseball and softball bats. More particularly, the present invention relates to a damper for a baseball or softball bat which is attached to a knob and/or end cap of the bat for damping vibrations created when the bat hits an object, such as a ball.

BACKGROUND OF THE INVENTION

Baseball and softball are very popular sports in many countries, including the United States, Mexico, Japan and elsewhere. Due to the competitive nature of these sports, players are constantly seeking ways of improving their performance. An important aspect of baseball and softball is the ability to effectively hit the ball.

Typically, wooden bats are used at the professional levels, while metal, such as aluminum and other metal alloys, and composite material bats are used extensively in other leagues and levels, and particularly in baseball amateur play from little league to college levels, and also in slow and fast pitch softball. Metal and composite bats are advantageous over wood bats in that they do not break and splinter like wood bats and thus can be used repeatedly with consequent cost savings. Metal and composite bats also have a larger optimal hitting area or power zone, often referred to as the sweet spot, than wood bats.

However, these bats also have certain disadvantages. Bats comprised of metal or composite materials or combinations thereof vibrate upon impact, particularly if the ball is not hit within the sweet spot of the bat. The shock caused by the bat hitting the ball may send painful vibrations into the batter's hands and arms.

Attempts to create bats having vibration dissipating or absorbing characteristics have often been complicated in nature in assembly and formation. Oftentimes, the interconnection points between the various components of the bat intended to dissipate or absorb vibrations are prone to failure as the bat is used repeatedly. Also, many of the designs do not effectively reduce the vibrations caused when the bat hits an object, such as a baseball or softball.

Accordingly, there is a continuing need for a bat which effectively dissipates vibrations and shock caused when hitting an object, such as a baseball or softball. Such a bat should not be complex in design and not expensive to manufacture or assemble and which is not prone to structural failure. Such a bat should also maintain a rigid and durable connection between the handle and the barrel of the bat. The present invention fulfills these needs and provides other related advantages.

SUMMARY OF THE INVENTION

The present invention resides in a baseball or softball bat. More particularly, the present invention resides in a bat having a gel damper attached to a knob and/or end cap of the bat that dissipates vibrations and shock caused when the bat hits an object, such as a baseball or softball.

A baseball or softball bat generally comprises a handle having a knob at an end thereof. A barrel extends from the handle. A cap is attached to an end of the barrel or the knob. The cap may comprise an end cap attached to an end of the barrel. Alternatively, or additionally, a portion of the cap may extend into a chamber formed in the knob.

The cap defines a chamber. The cap may have an end wall and a side wall that cooperatively form an open-ended chamber. The side wall of the cap may have threads that threadedly connect to the knob or barrel of the bat. The cap may include a plurality of chambers.

A gel partially fills the chamber of the cap for at least partially dissipating vibrations created when the bat strikes an object. The gel may be comprised of a polymer material. The gel may be comprised of a polyurethane gel or silicone gel. The gel may have a Shore A hardness of 0-2. The gel may have a viscosity of between 1800 to 300,000 centipoise. The gel may fill between 25% to 90% of the chamber of the cap. The gel may fill between 50% to 80% of the chamber of the cap. A cover may be disposed over an aperture or open end of the chamber that retains the gel within the chamber.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention relates to a vibration damper for a knob and/or an end cap of a bat, such as a baseball or softball bat or the like. The violent collision between a ball and a bat causes vibration of the bat and flexural mode shapes contributing to the painful sting in one or both hands of the hitter. This results when the bat impacts the ball away from the "sweet spot", which is typically approximately four to seven inches from the barrel end of the bat, and is most frequently felt in the small section of the handle section where the batter holds the handle. The stinging vibration is often felt between the thumb and forefinger in the top hand farthest away from the knob at the end of the handle. The vibration damper of the present invention is designed to resist dynamic forces through a combination of strength, deformation and energy absorption. The damper dissipates vibration that is caused by the impact between a ball and a bat that would otherwise be transmitted to cause sting or injuries in the hands and arms of the batter.

Figure 1:
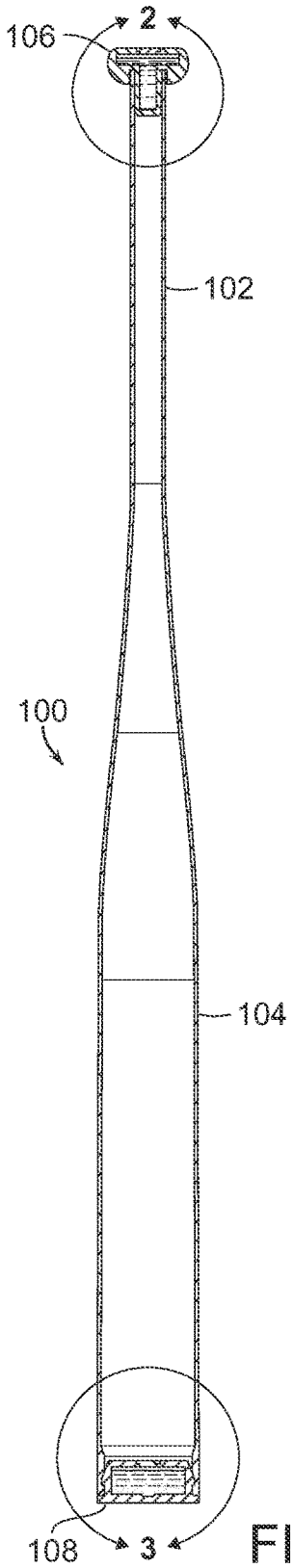
FIG. 1 is a cross-sectional view of a softball or baseball bat incorporating the gel damper of the present invention in a knob and end cap thereof.

With reference now to FIG. 1, a cross-sectional view of a bat 100 is shown. The bat 100 is typically of the type used in baseball and softball. The bat 100 is comprised of a handle section 102 which the batter grips and a barrel section 104 which is typically enlarged in diameter with respect to the handle 102 and used to hit a ball or other object. The handle 102 and barrel 104 may be formed integrally with one another, as separate sections attached to one another, or the handle 102 and/or the barrel 104 sections may be formed of multiple sections. The bat 100 is typically comprised of a metal or composite material, or combinations thereof. For example, the bat 100 may be comprised of an aluminum alloy material, other metal alloys, composite materials, or combinations thereof. The damper of the present invention can be incorporated into a wide variety of types of bats comprised of many different types of materials and having many different arrangements.

In accordance with the present invention, a gel damping material is disposed and contained within a chamber within the bat 100. Typically, as will be more fully described herein, the gel damping material is disposed within the chamber of a knob 106 attached to an end of the handle 102 or end cap 108 attached to an open end of the barrel 104. The damper can be any gel which has a minimum viscosity of 1800 centipoise (cps). Typically, the gel material is a polymer gel having a minimum viscosity of 1800 cps. The gel may comprise a silicone-based gel or a polyurethane gel. The viscosity of the gel could be greater than 1800 cps, such as having a dynamic viscosity of 30,000-300,000 cps. The gel damping material typically has a Shore A hardness of 0-2 (unit: A). The flowability of the gel damping material in accordance with a cone penetration test may be 100-300 (unit: 1/10 mm), as an indicator of flowability or dynamic viscosity of materials, such as gel materials which may be used in accordance with the present invention.

Figure 3:
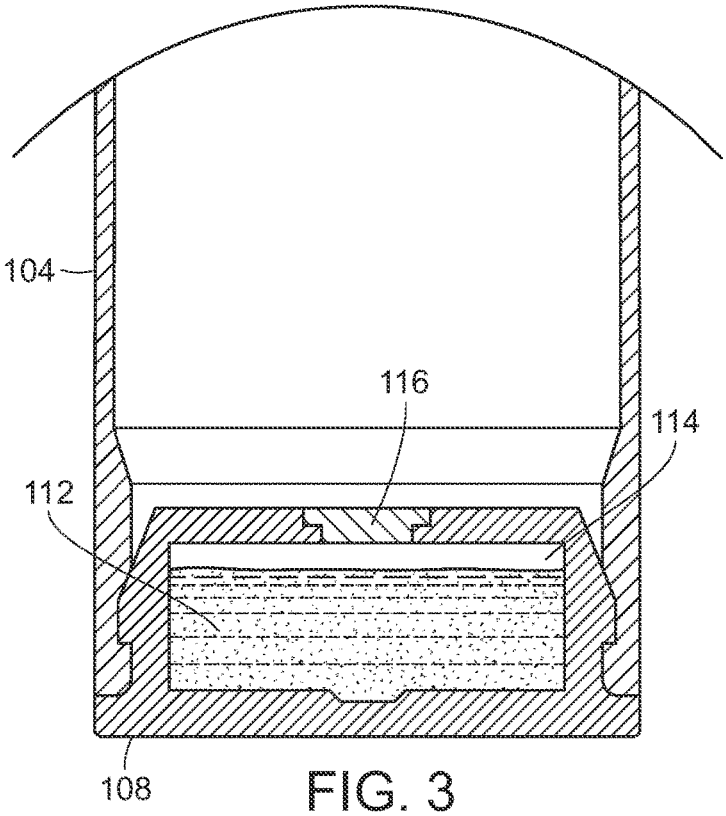
FIG. 3 is an enlarged cross-sectional view of area "3" of FIG. 1, illustrating an end cap attached to an end of the barrel of the bat and having a vibration damping or dissipating gel disposed within a chamber thereof, in accordance with the present invention.
Figure 4:
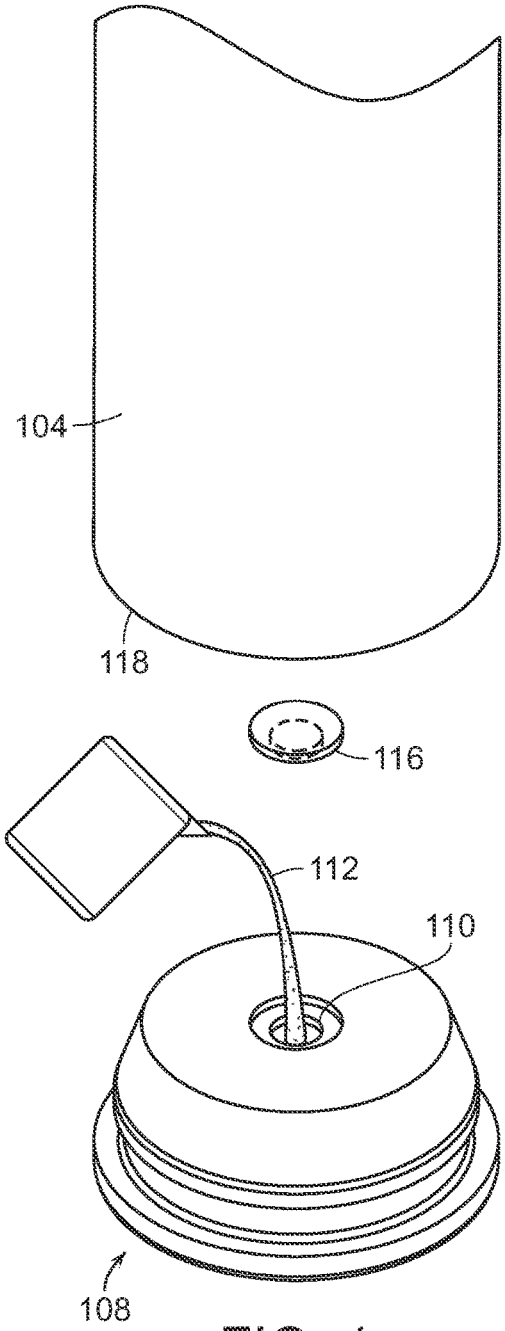
FIG. 4 is an exploded perspective view illustrating gel being poured into a chamber of an end cap, in accordance with the present invention.
Figure 5:
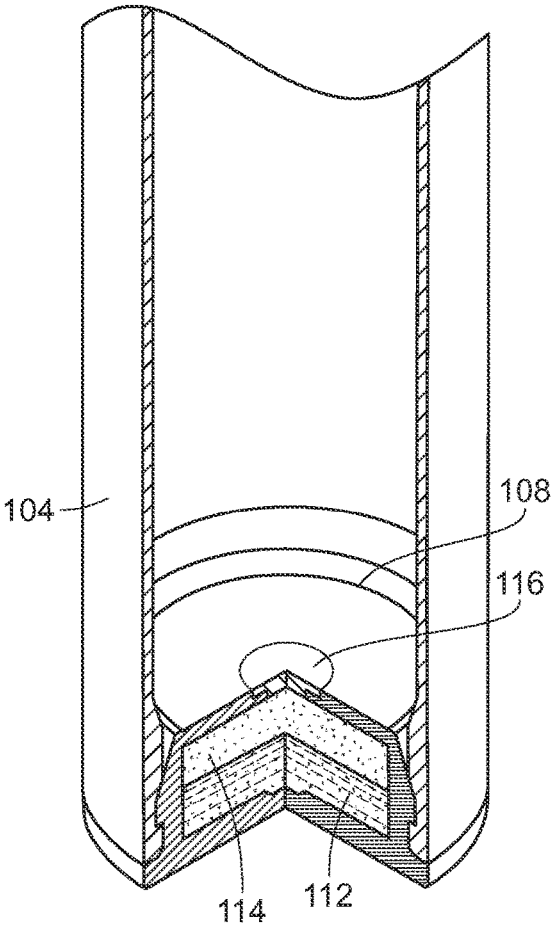
FIG. 5 is a partially sectioned view of the components of FIG. 4, illustrating the gel within the chamber of the end cap, in accordance with the present invention.

With reference now to FIGS. 3-5, a gel damping material placed within the end cap 108 of the bat 100 is shown. More particularly, as illustrated in FIG. 4, the end cap 108 may include an aperture or opening 110 through which the gel 112 is inserted into the chamber 114 defined by the end cap 108. The gel 112 may be poured into the chamber 114 through the aperture 110, as illustrated in FIG. 4, injected into the chamber 114, or by any other means suitable to place the gel material 112 into the chamber 114. The gel material may be in a liquid state when added to the chamber 114, such as shortly after mixing its components or being at an elevated temperature, etc., but then the gel sets over time into a gel material.

The chamber 114 may be partially filled or fully filled, such as having a volume ratio of 10% to 90% of the chamber 114. It has been found, however, that when the gel 112 fills less than 20% of the chamber 114, while there is a vibration damping effect, the damping is not as great as would be desired. Thus, preferably the gel 112 has a volume ratio or fills at least 25% of the chamber 114, and more preferably fills at least 50% of the chamber 114. It has also been found that the vibration damping effect is slightly reduced if the chamber 114 is 100% filled. Accordingly, for maximum vibration damping effect, the chamber 114 is filled between 25% to 90%, and more preferably 50% to 80%. Within these volume ratios, the vibrations caused when the bat hits a ball or other object is significantly dissipated by the gel damping material 112.

A cover or plug 116 may be disposed over the chamber aperture 110 so as to retain the gel damping material 112 within the chamber 114. The cover 116, which may be in the form of a plug, lid or the like, may have a thin layer of adhesive applied to an outer surface which may be threaded or unthreaded, and then attached to the end cap 108 so as to completely cover the aperture 110 through which the gel 112 is inserted through. In the embodiments illustrated in FIGS. 2-5, the aperture 110 is relatively small as is the cover of plug 116. Moreover, the cover or plug 116 is not threaded. However, it will be understood that the aperture 110 could be much larger and the cover 116 have a threaded attachment to the end cap 108 or the knob 106.

With reference again to FIGS. 3-5, once the chamber 114 of the end cap 108 has the gel material 112 added thereto, and the cover 116 securely positioned and attached to the end cap 108, the end cap then is attached to the barrel 104 of the bat, such as at the hollow open end of the bat such that the end cap 108 is firmly attached to the barrel 104. This may be by means of a variety of arrangements and processes, including threaded attachment, snap-fit attachment and additionally, or alternatively, adhesively attached, as is known in the art.

Figure 2:
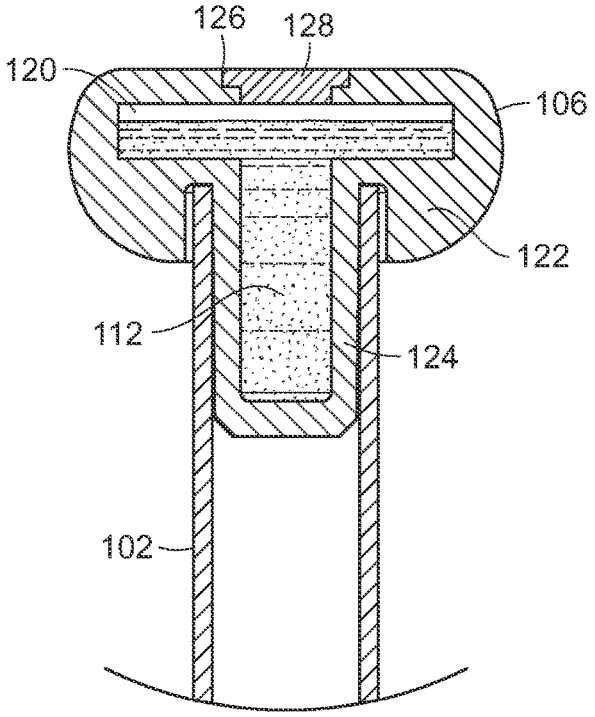
FIG. 2 is an enlarged sectional view of area "2" of FIG. 1, illustrating a vibration dissipating or damping gel disposed within a chamber of the knob of the bat, in accordance with the present invention.

With reference now to FIG. 2, an enlarged sectioned view of area "2" of FIG. 1 is illustrated, having a knob 106 attached to an end of the handle 102, generally opposite the barrel 104 of the bat 100. A gel-receiving chamber 120 is formed in the knob 106. The knob 106 is typically comprised of a metal, such as aluminum, or a polymer material. The knob 106 may have an enlarged end 122, which has a diameter which is greater than the portion of the handle 102 immediately adjacent to the knob 106. The knob 106 may also include a portion 124 which is narrower in diameter so as to be insertable into the open end of the handle 102, as illustrated in FIG. 2. The chamber 120 may be formed in either or both of these portions 122 and/or 124 of the knob 106. As illustrated in FIG. 2, the chamber 120 is formed in both the narrower portion 124 as well as the enlarged portion 122.

As discussed above, with respect to FIGS. 3-5, the gel damping material 112 is disposed within the chamber 120. This may be by means of pouring, injecting, etc. The chamber 120 is at least partially filled, such as at least 10%, and may be fully filled, such as 100% filling the chamber 120, more preferably, as indicated above, the chamber 120 is filled 25%-90%, and more preferably 50%-80% with the gel material 112. The gel material 112 is passed through an aperture or opening 126, after which it is sealed with a cover 128 in the manner described above. Thereafter, the knob 106 is attached to the open end of the handle 102. This may be, for example, by inserting the smaller portion 124 of the knob 106 into the handle 102 which may form a friction fit and/or an adhesive fit therebetween so as to retain the knob 106 onto the end of the handle 102.

A bat 100 may be equipped with a knob 106 having the gel damping material therein and/or an end cap 108 having the gel damping material. As the gel 112 has a relatively high viscosity, it has a significant vibration damping effect when the bat 100 strikes an object, such as a ball. It is believed that the frequency of the gel matches the frequency of the bat so as to provide such vibration damping or dissipating effects. The energy from the vibrations of the bat are transferred into the gel instead of into the hands and arms of the batter.

With reference now to FIGS. 6-9, instead of pouring, injecting, or otherwise inserting the gel directly into the chamber of the knob 106 or end cap 108, the gel may be contained within a flexible enclosure 130. Such a flexible enclosure 130 may comprise, for example, a plastic or elastomeric material or the like which is flexible and which will retain the gel material 112 therein.

Figure 6:
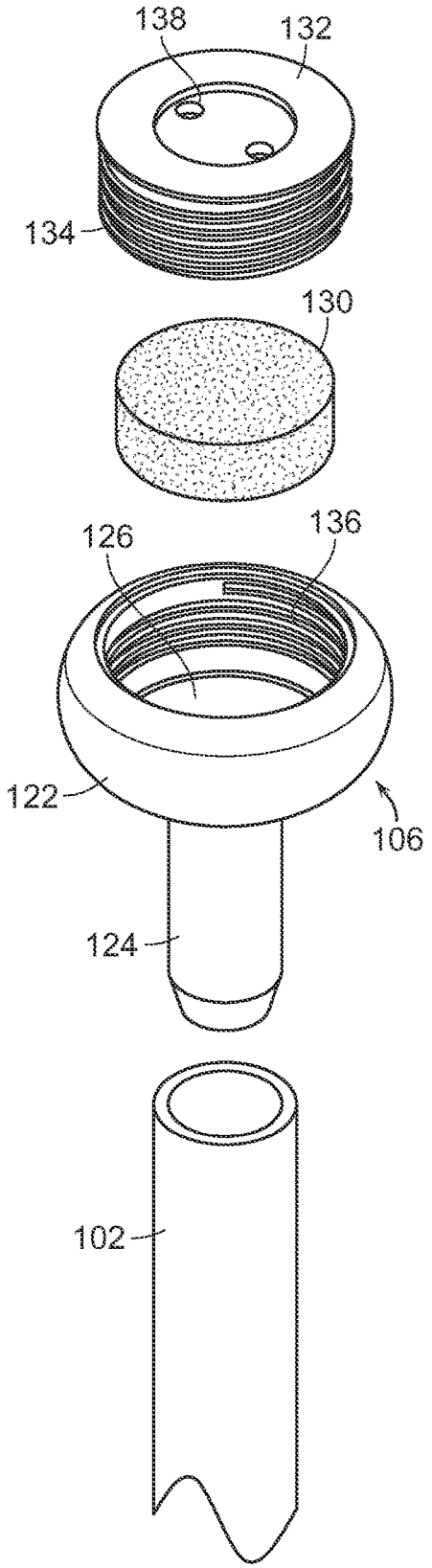
FIG. 6 is an exploded perspective view of a knob having a chamber to receive a flexible enclosure containing the gel and a cover for retaining the enclosure within the knob, in accordance with the present invention.
Figure 7:
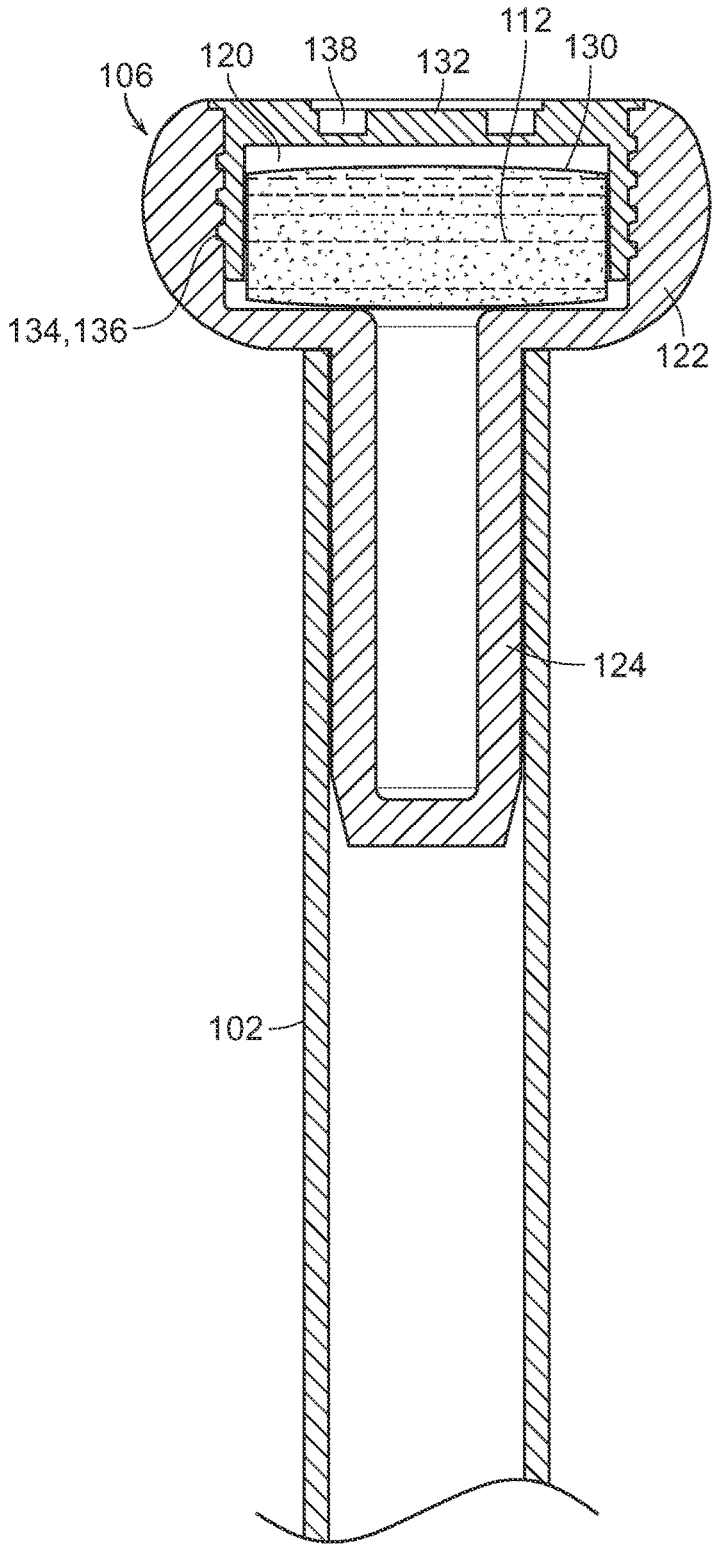
FIG. 7 is a cross-sectional view of the assembled components of FIG. 6 with a knob attached to an end of the handle of the bat.

With reference now to FIGS. 6 and 7, the aperture or opening 126 of the knob 106 is sufficiently large so as to receive the flexible enclosure 130 containing the gel 112 therein and into the chamber 120 of the knob 106. The flexible enclosure 130 may partially fill the chamber 120 or fully fill the chamber, such as between 10%-95%, but more preferably fills 25%-90%, and even more preferably 50%-80% of the chamber 120 to maximize the damping and dissipating effects. Alternatively, the flexible enclosure 130 may fill the chamber 120 but the flexible enclosure 130 only be partially filled with the gel material.

A larger cover 132 is then attached to the knob 106 so as to cover the aperture 126 and retain the gel filled enclosure 130 within the chamber 120. The cover may be adhesively attached to the knob 106. Alternatively, or additionally, the cover 132 may have a threaded attachment, such as by having external threads 134 which are received into internal threads 136 of the knob, as illustrated. A thin layer of adhesive may be applied to the external threads 134 of the cover 132 to securely attach the cover 132 to the knob 106 and retain the gel filled flexible enclosure 130 within the knob 106. The cover 132 may include recesses 138 for mechanically and physically rotating the cover 132 with respect to the knob 106 so as to securely attach and couple the cover 132 and knob 106 to one another. The assembled knob 106 is then attached to the handle 102, as illustrated in FIG. 7, and as described above and as is well known in the art.

Figure 8:
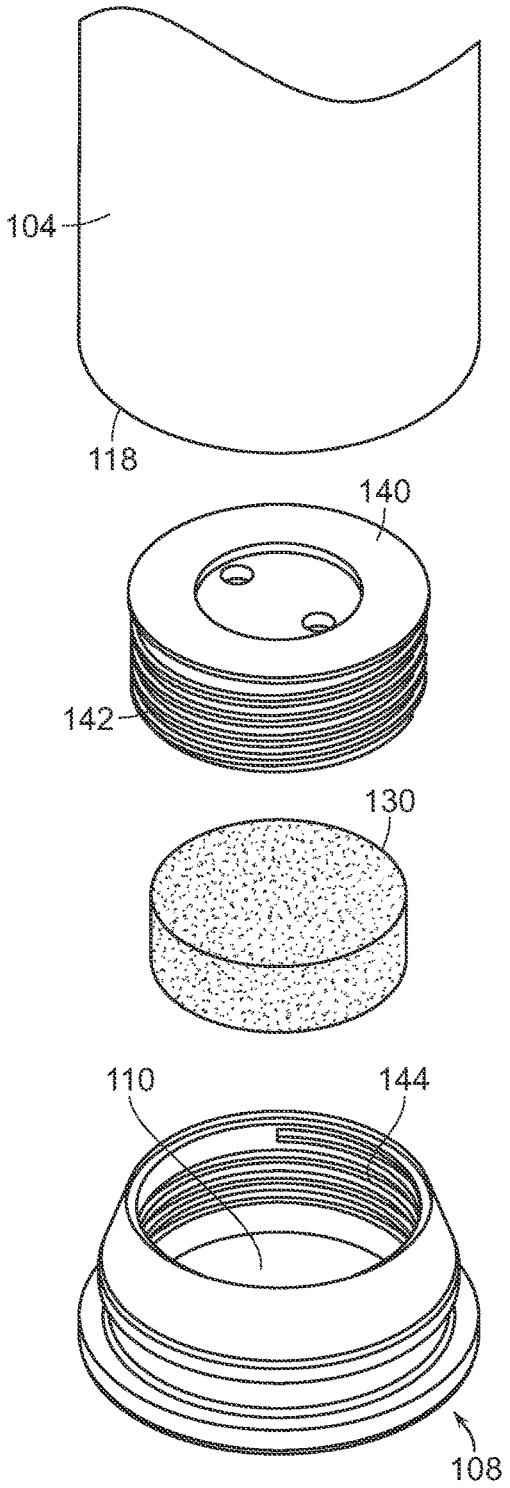
FIG. 8 is an exploded perspective view illustrating an end cap having a chamber that receives a flexible enclosure having gel therein, and a cover for retaining the enclosure within the end cap.
Figure 9:
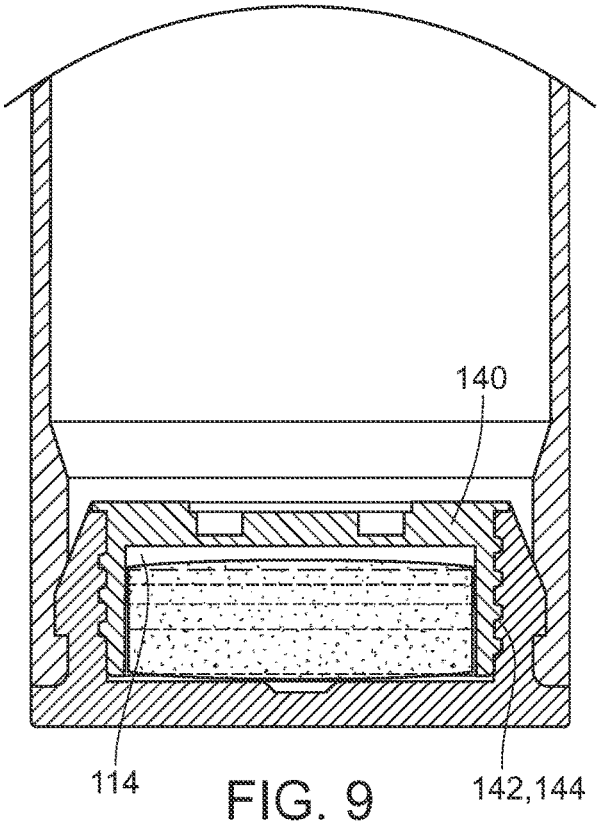
FIG. 9 is a cross-sectional view of the components of FIG. 8 in an assembled state at the end of the barrel of the bat.

With reference now to FIGS. 8 and 9, in a similar fashion, a flexible enclosure 130 containing the gel damping material 112 may be inserted into the chamber 114 of the end cap 108. The aperture or opening 110 of the end cap 108 is sufficiently large so that the flexible enclosure 130 may be inserted therethrough and into the chamber 114. Similar to the knob illustrated and described above, a cover 140 is then placed over the opening 110 so as to retain the flexible enclosure of gel material 130 within the chamber 114 and within the end cap 108. Similar to that described above, the cover 140 may have external threads 142 which are threadedly attached to internal threads 144 of the end cap 108. Additionally, or alternatively, a layer of adhesive may be placed over the exterior surface of the cover 140 and/or inner surface of the end cap 108 so as to adhere and securely attach the cover 140 to the end cap 108. As mentioned above, the flexible enclosure 130 may at least partially fill the chamber 114 or fully fill the chamber 114, such as between 10% to 95%, but more preferably filled by a ratio of volume 25%-90%, and more preferably 50%-80% to maximize the vibration damping and dissipating effects of the invention. The assembled end cap 108 is then attached to the end 118 of the barrel 104 of the bat, as illustrated in FIG. 9, and as described above.

Figure 10:
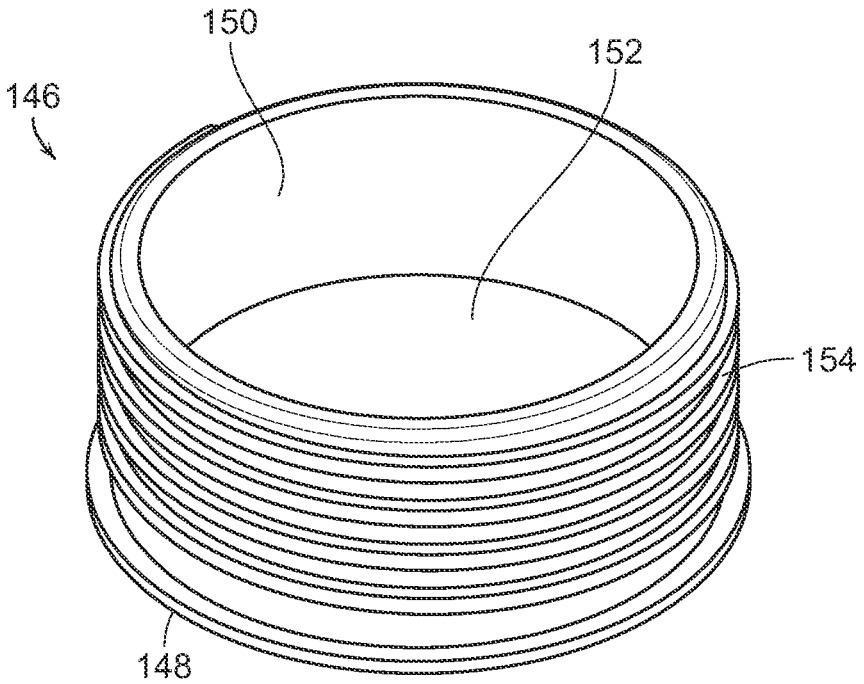
FIG. 10 is a front perspective view of a cap embodying the present invention.
Figure 11:
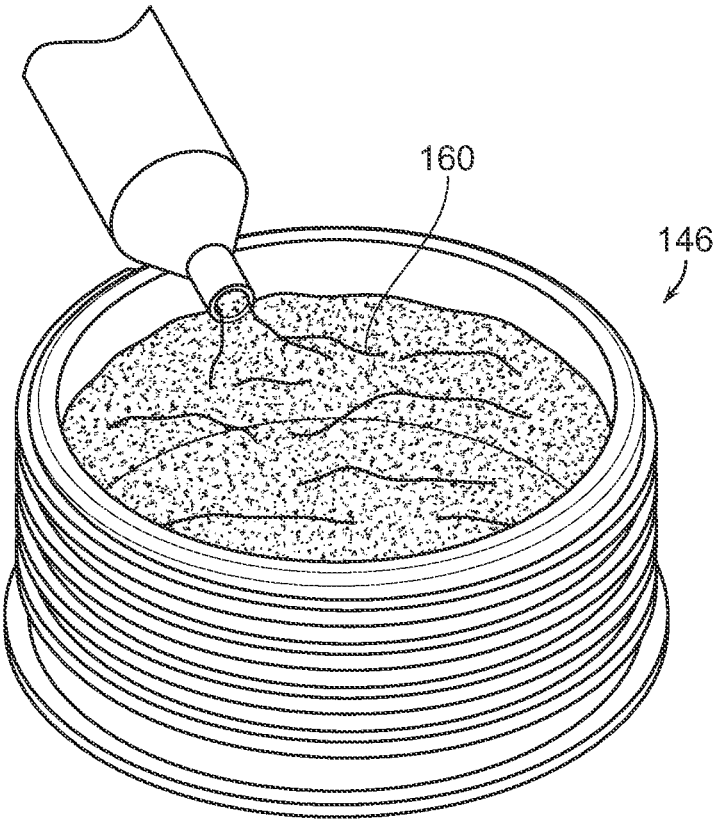
FIG. 11 is a front perspective view of the cap of FIG. 10 being partially filled with vibration dampening gel material, in accordance with the present invention.
Figure 12:
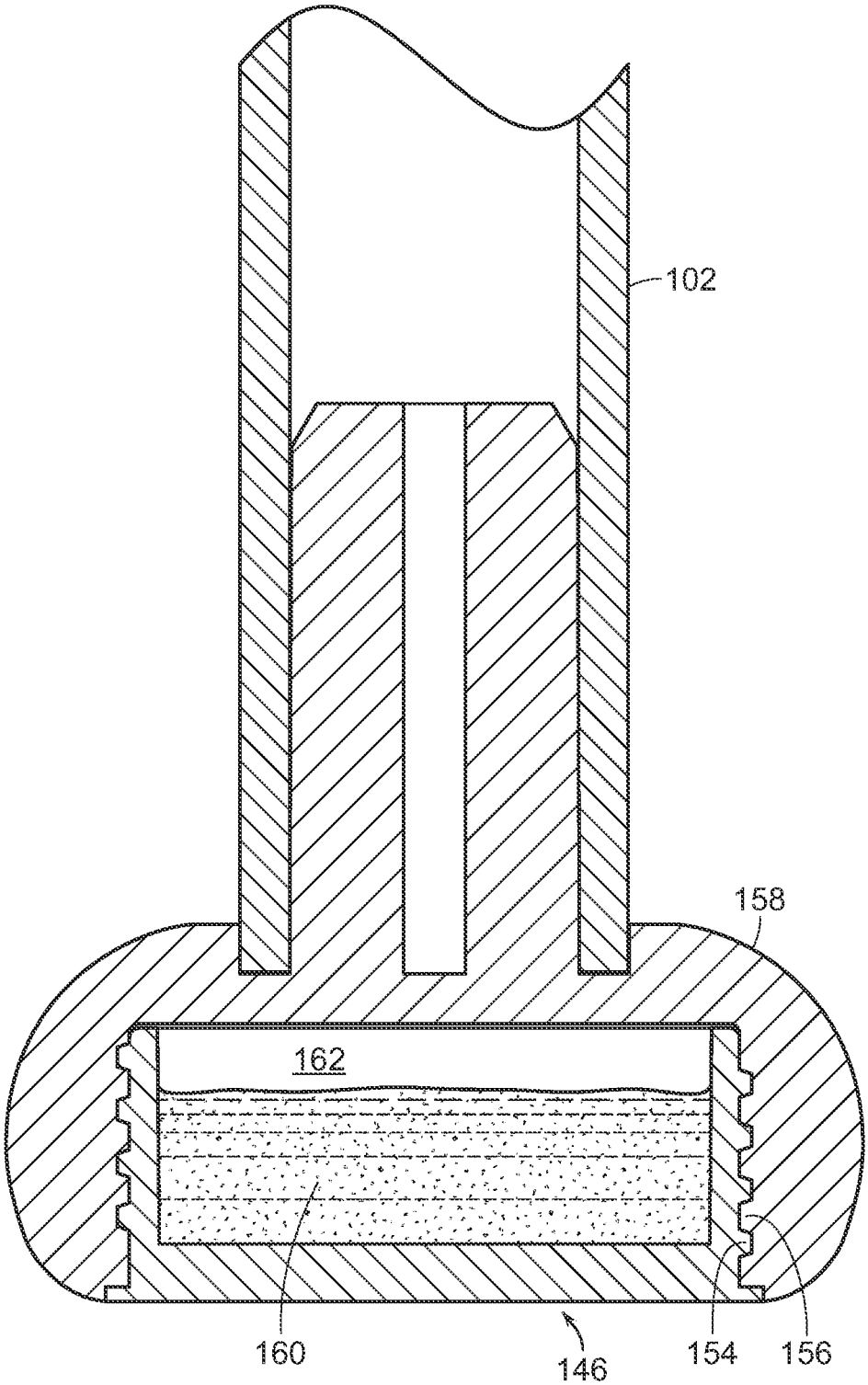
FIG. 12 is a cross-sectional view illustrating a partially gel-filled cap attached to a knob of the bat, in accordance with the present invention.

With reference now to FIGS. 10-12, a cap 146 has an end wall 148 and a side wall 150 extending from the end wall 148 so as to define an open-ended chamber 152. The side wall 150 of the cap 146 may include threads 154 for threaded connection to internal threads 156 of a knob 158. The knob 158 is connected to the end of the handle 102 of the bat 100, such as described above. It will be understood that the cap 146 could be attached to the knob 158, such as the inner cavity or chamber 162 of the knob 158 by a variety of means and arrangements, including the illustrated threaded attachment, snap-fit attachment, by adhesion, or combinations thereof.

The chamber 152 of the cap 146 is partially filled with the vibration dampening gel material 160. As described above, the gel material is a polymer gel, such as a silicone gel or polyurethane gel having a Shore A hardness of 0-2 and a centipoise rating of at least 1800, and more preferably 30,000-300,000 cps. The gel material 160 fills between 10%-95%, but more preferably fills between 25%-90%, and even more preferably 50%-80% of the chamber 152 to maximize the vibration damping and dissipating effects. As the gel material sets, it attaches to the interior walls of the chamber 152 in an adhesive-like manner.

After the gel is set, the cap 146 is attached to the knob 158 and as the bat 100 is used and vibrations are created, the gel material 160, which is in contact with the side wall 150 of the cap 146, which is in contact with the knob 158, the vibrations are transferred to the gel material 160 and dissipated so as to protect the hands of the batter.

Figure 13:
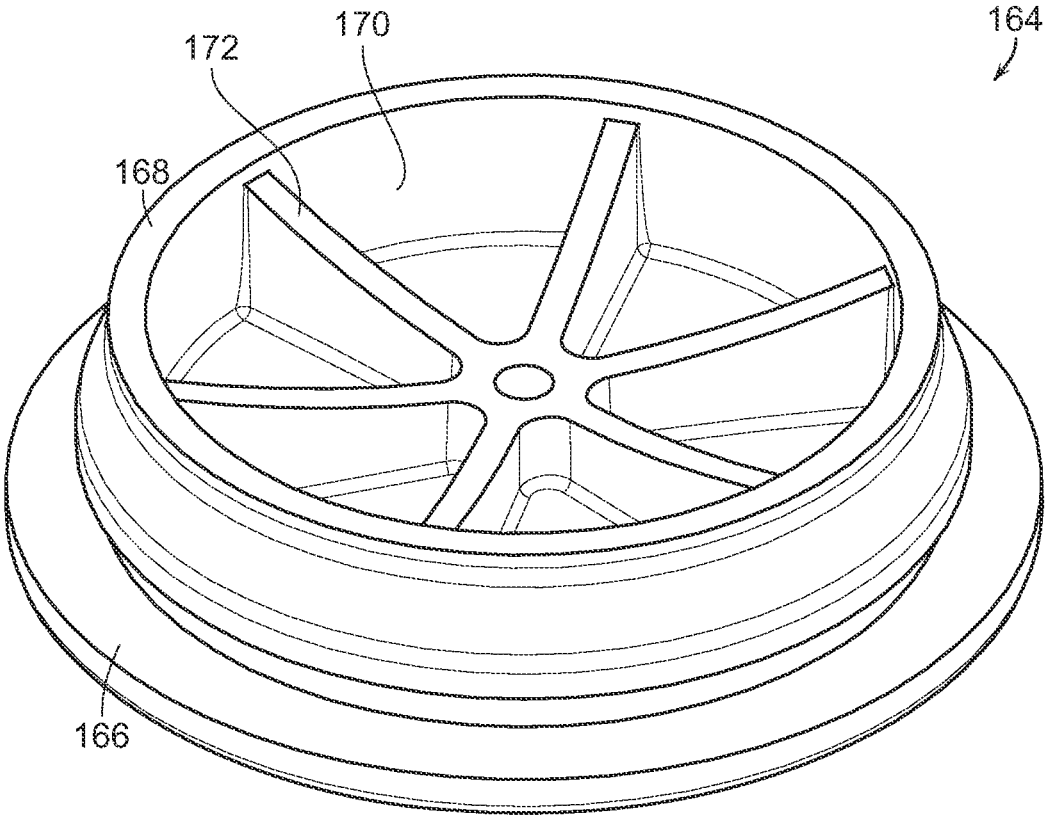
FIG. 13 is an upper perspective view of another cap embodying the present invention.
Figure 14:
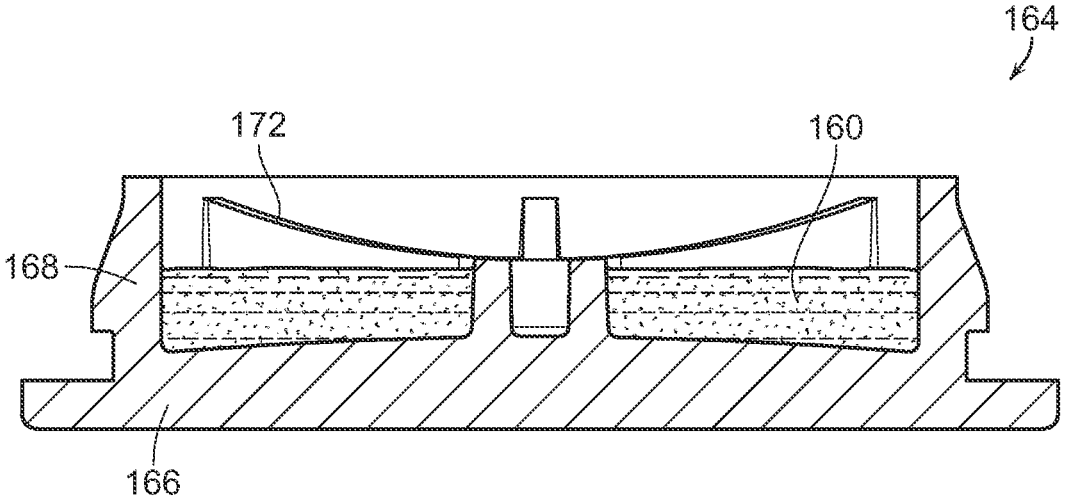
FIG. 14 is a cross-sectional view of the cap of FIG. 13, illustrating chambers thereof partially filled with gel in accordance with the present invention.
Figure 15:
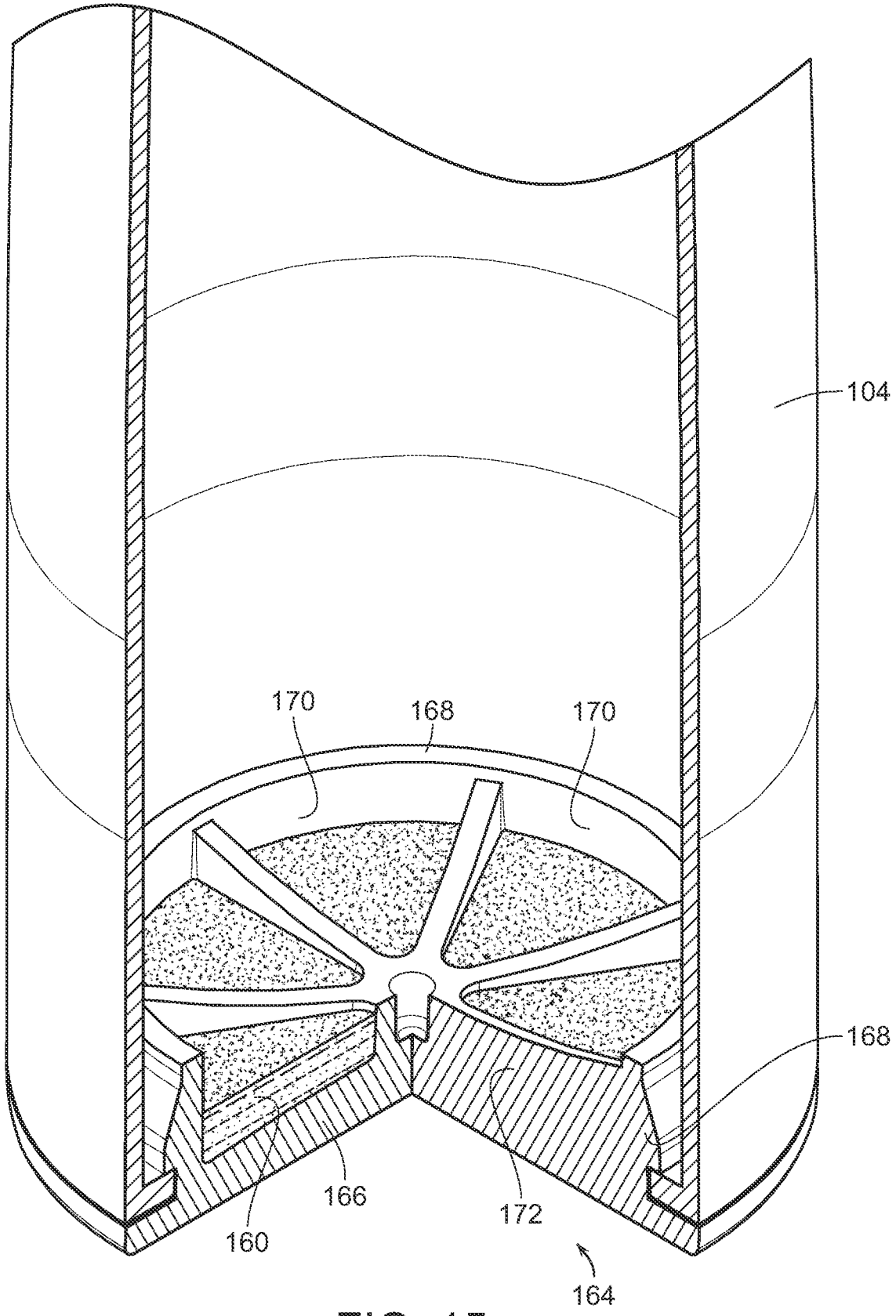
FIG. 15 is a partially sectioned perspective view illustrating the cap of FIG. 14 attached to an end of a barrel of a bat, in accordance with the present invention.
Figure 16:
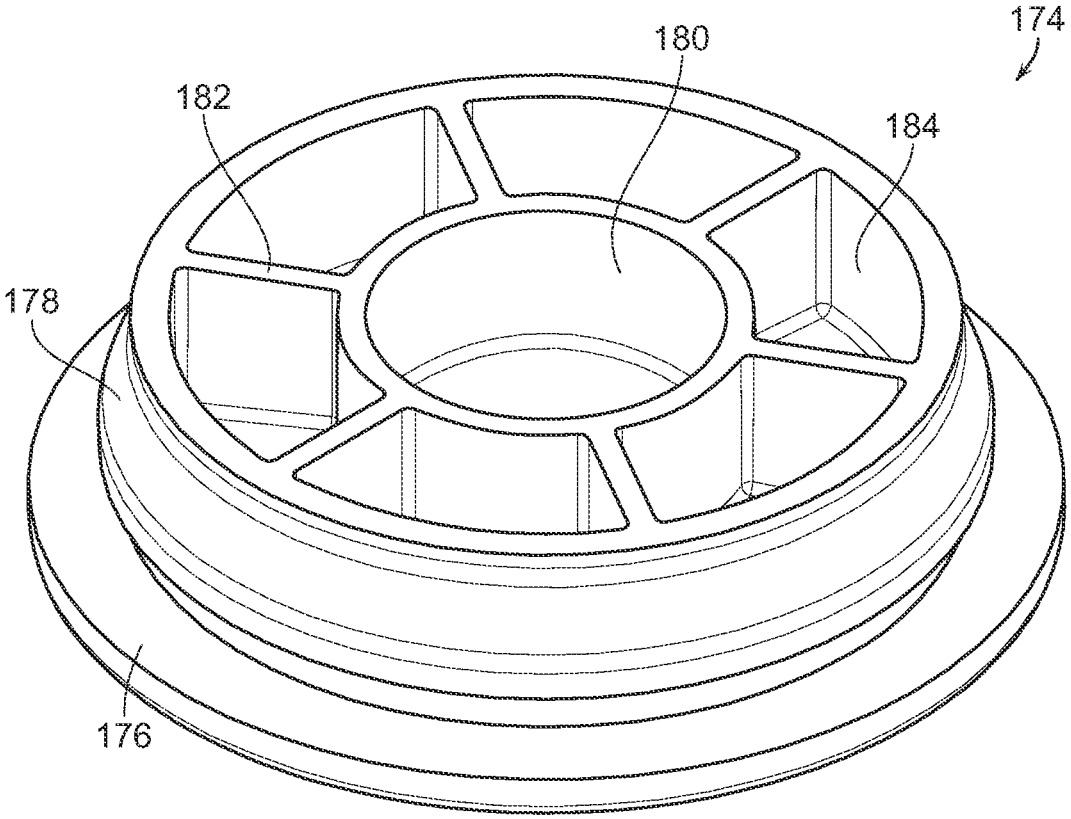
FIG. 16 is an upper perspective view of a cap embodying the present invention.

With reference now to FIGS. 13-15, another cap 164 embodying the present invention is shown. This cap 164 also includes an end wall 166 having a side wall 168 extending therefrom and forming at least one chamber 170. In this case, dividing walls 172 within side wall 168 form multiple chambers 170.

As illustrated in FIGS. 14 and 15, the gel material 160 partially fills at least one of the chambers 170, and preferably all of the chambers 170. Once the gel is set, the cap 164, which serves as an end cap to the barrel 104, is attached to an open end of the barrel. This may be by a variety of means, including threaded connection, adhesive, press-fit, wherein the cap 164 and the end of the barrel 104 have interengaging and interlocking profiles, etc. Once again, as the bat 100 strikes an object and vibrations are created, the vibrations travel through the barrel 104 to the cap 164 and into the gel material 160, where the vibrations are dissipated.

With reference now to FIGS. 16-19, another cap 174, in the form of a barrel end cap, is shown. The cap 174 includes an end wall 176 having a side wall 178 extending therefrom. The end wall 176 and side wall 178 cooperatively define at least one chamber 180. In the illustrated embodiment, internal dividing walls 182 create a central chamber 180 and additional peripheral chambers 184.

Figure 17:
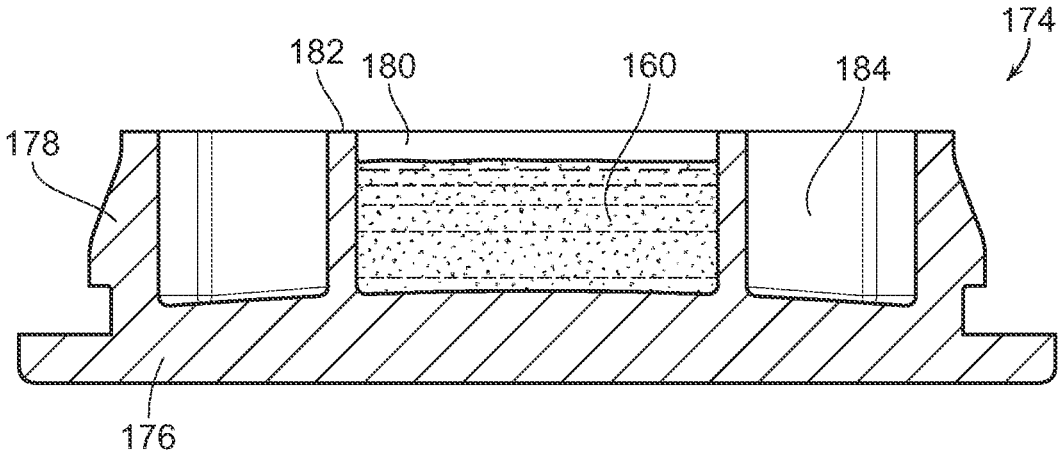
FIG. 17 is a cross-sectional view of the cap of FIG. 16, illustrating a chamber thereof partially filled with gel.
Figure 18:
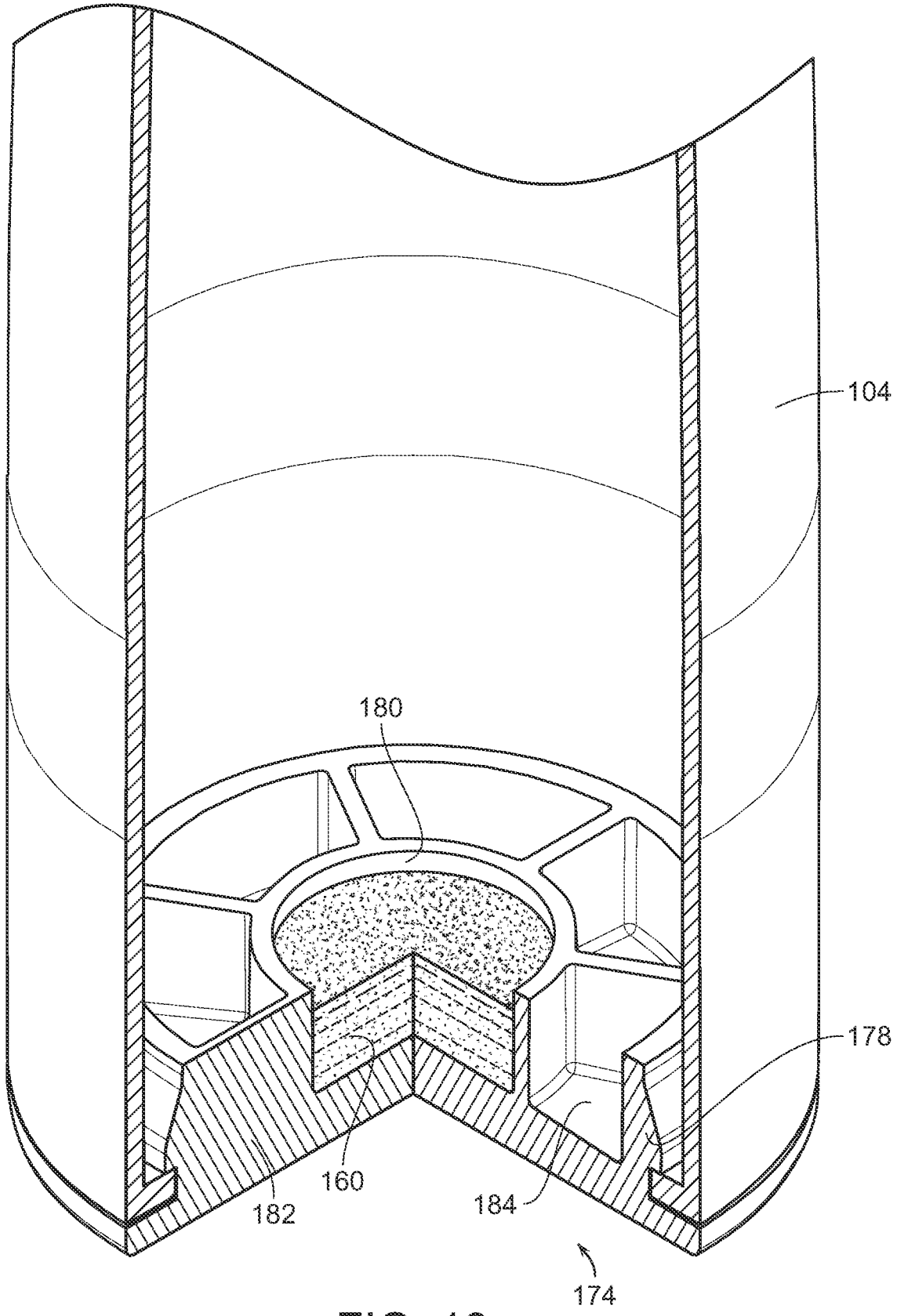
FIG. 18 is a partially sectioned perspective view of the cap of FIG. 17 attached to an end of a barrel of a bat, in accordance with the present invention.

As illustrated in FIG. 17, at least one of the chambers, typically the central chamber 180 is partially filled with the gel material 160. Only one of the chambers or a plurality of the chambers, or even all of the chambers could be filled with the gel material. It is important, however, that the gel material 160 has a physical connection to at least one wall 178 and/or 182 and/or 176 which is in contact with the barrel 104, such that as an object strikes the bat 100 and vibrations are generated, the vibrations travel through the barrel 104, into the end cap 174 and into the gel material 160, where the vibrations are dampened and dissipated.

Figure 19:
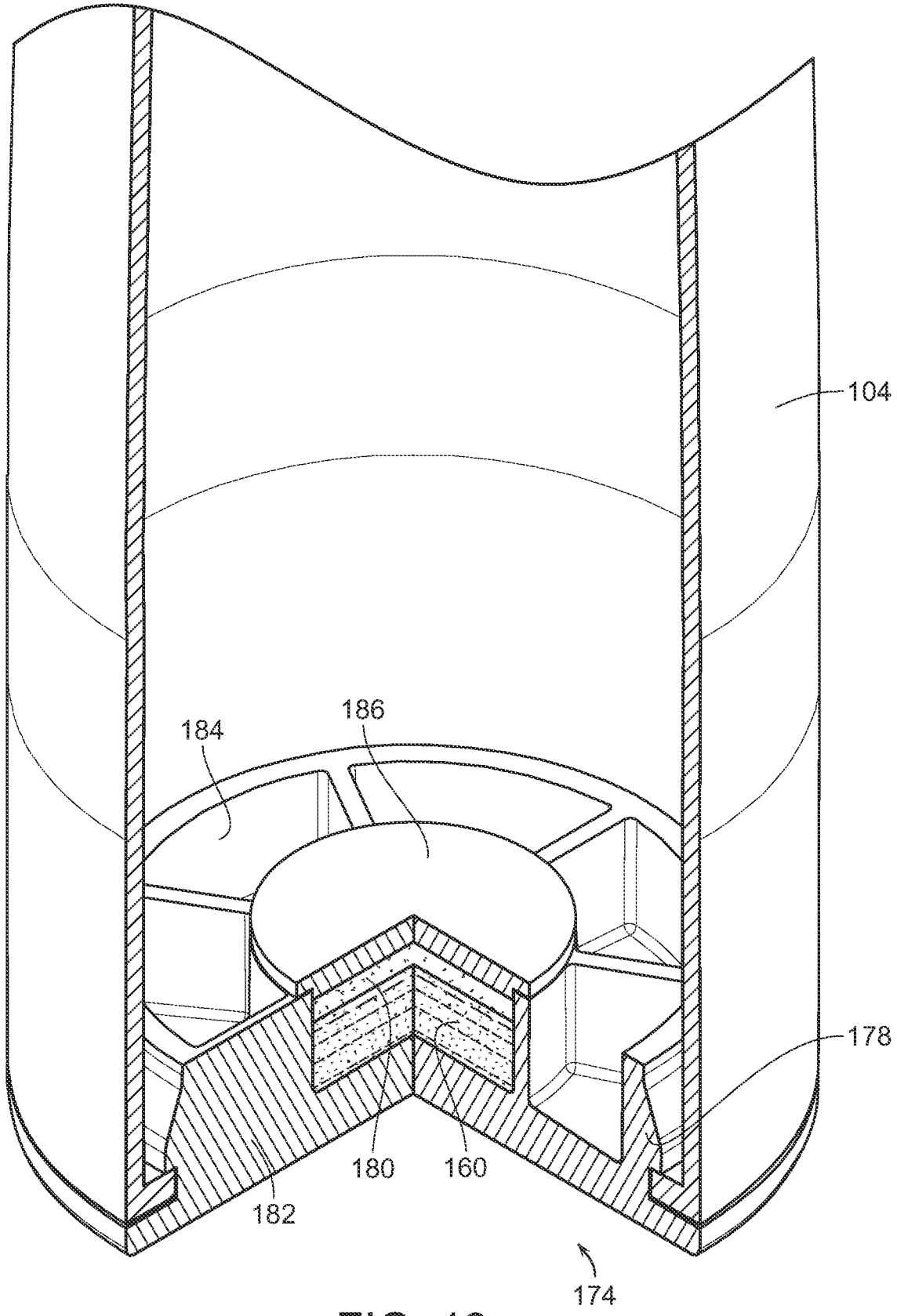
FIG. 19 is a cross-sectional view similar to FIG. 18, and illustrating a cover placed over the partially gel-filled chamber of the cap.

With reference now to FIG. 19, a cover 186 may be disposed over the aperture or open end of the chamber 180 containing the gel 160. The cover 186 serves to keep the gel material within the chamber 180 during use of the bat 100. Otherwise, there exists the possibility that the gel material 160 could become dislodged from the chamber 180. It will be understood that a cover could be disposed over any of the chambers illustrated herein which contain the gel material so as to retain the gel material within the chamber of the cap.

When the bat 100 strikes an object, such as a ball, and vibrations are created, the energy of the vibrations are transferred through the cap and into the gel damping material and thus avoid the energy from the vibrations going into the hands and arms of the batter, causing pain. It is believed that a minimum amount of gel is necessary to maximize the vibration dissipating or damping effects of the invention. However, the weight of the gel material should preferably be between 0.5-2.5% of the overall weight of the bat. While the damping material 112 has been illustrated and described above as being disposed within chambers formed in the knob and/or end cap, the present invention also contemplates that chambers could be formed in other areas of the bat, including the barrel, handle or taper section therebetween.

Although several embodiments have been described in detail for purposes of illustration, various modifications may be made without departing from the scope and spirit of the invention. Accordingly, the invention is not to be limited, except as by the appended claims.

What is claimed is:

1. A baseball or softball bat, comprising:
a handle having a knob at an end thereof;
a barrel extending from the handle;
a cap attached to an end of the barrel or the knob, the cap defining a chamber; and
a gel partially filling the chamber of the cap for at least partially dissipating vibrations created when the bat strikes an object;
wherein a portion of the cap extends into a chamber formed in the knob.

2. A baseball or softball bat, comprising:
a handle having a knob at an end thereof,
a barrel extending from the handle;
a cap attached to an end of the barrel or the knob, the can defining a chamber; and
a gel partially filling the chamber of the cap for at least partially dissipating vibrations created when the bat strikes an object;
wherein the gel fills 25% to 90% of the chamber of the cap.

3. The bat of claim 2, wherein the gel fills 50% to 80% of the chamber of the cap.

4. A baseball or softball bat, comprising:
a handle having a knob al an end thereof;
a barrel extending from the handle;
a cap attached to an end of the barrel or the knob, the cap defining a chamber; and
a gel partially filling the chamber of the can for at least partially dissipating vibrations created when the bat strikes an object;
wherein the gel has a viscosity of 1800 to 300,000 centipoise.

5. A baseball or softball bat, comprising:
a handle having a knob at an end thereof;
a barrel extending from the handle;
a cap attached to an end of the barrel or the knob, the cap defining a chamber; and
a gel partially filling the chamber of the can for at least partially dissipating vibrations created when the bat strikes an object;
wherein the gel has a Shore A hardness of 0-2.

6. A baseball or softball bat, comprising:
a handle having a knob at an end thereof;
a barrel extending from the handle;
a cap attached to an end of the barrel or the knob, the cap defining a chamber;
a gel partially filling the chamber of the cap for at least partially dissipating vibrations created when the bat strikes an object;
including a cover disposed over an aperture or open end of the chamber that retains the gel within the chamber.

7. A baseball or softball bat, comprising:
a handle having a knob at an end thereof;
a barrel extending from the handle;
a cap attached to an end of the barrel or the knob, the cap defining a chamber; and
a gel partially lilting the chamber of the cap for at least par tally dissipating vibrations created when the bat strikes an object;
wherein the cap includes a plurality of chambers that are partially filled with the gel.

8. A baseball or softball bat, comprising:
a handle having a knob at an end thereof;
a barrel extending from the handle;
a cap attached to an open end of the barrel or the knob, the cap having a side wall extending from an end wall that cooperatively define an open-ended chamber; and
a polymer gel material filling between 25% and 90% of the chamber of the cap for at least partially dissipating vibrations created when the bat strikes an object.

9. The bat of claim 8, wherein the cap comprises an end cap attached to the end of the barrel.

10. The bat of claim 8, wherein a portion of the cap extends into a chamber formed in the knob.

11. The bat of claim 8, wherein the gel fills 50% to 80% of the chamber of the cap.

12. The bat of claim 8, wherein the gel is comprised of a polyurethane gel or silicone gel.

13. The bat of claim 8, wherein the gel has a viscosity of 1800 to 300,000 centipoise.

14. The bat of claim 8, wherein the gel has a Shore A hardness of 0-2.

15. The bat of claim 8, wherein the cap has threads that threadedly connect to the knob or the barrel.

16. The bat of claim 8, including a cover disposed over an aperture or open end of the chamber that retains the gel within the chamber.

17. The bat of claim 8, wherein the cap Includes a plurality of chambers that are partially filled with the gel.

* * * * *